United States Patent [19]

Bushell

[11] 4,103,850

[45] Aug. 1, 1978

[54] MANEUVERABLE GLIDER KITE

[76] Inventor: Helen Bushell, 10 Elm Grove, North Kew, Victoria 3102, Australia

[21] Appl. No.: 664,455

[22] Filed: Apr. 1, 1976

[30] Foreign Application Priority Data

Apr. 9, 1975 [AU] Australia ..... 83667/75

[51] Int. Cl.[2] ..... B64C 31/06

[52] U.S. Cl. ..... 244/153 R

[58] Field of Search ..... 244/153 R, 154, DIG. 1; D34/15 AF; 46/76 R, 77, 79

[56] References Cited

U.S. PATENT DOCUMENTS

| | | | |
|---|---|---|---|
| 919,436 | 4/1909 | Jackson | 244/153 R |
| 1,105,058 | 7/1914 | Bochau | 244/153 R |
| 3,428,277 | 2/1969 | Everett, Jr. | 244/DIG. 1 |
| 3,534,932 | 10/1970 | Christoffel et al. | 244/153 R |
| 3,963,200 | 6/1976 | Arnstein | 244/153 R |

FOREIGN PATENT DOCUMENTS

| | | | |
|---|---|---|---|
| 28 of | 1926 | Australia | 46/79 |

*Primary Examiner*—Stephen G. Kunin

*Assistant Examiner*—Galen L. Barefoot

[57] ABSTRACT

A kite is disclosed having a main body portion fabricated of a flexible material consisting of two substantially triangular panels joined along one edge, and joined again, in an aerodynamic curve, adjacent to, and roughly parallel with, the original join, forming a keel foil enclosing roughly one quarter of the sail area. This keel foil, being double fabric, forms a pocket to hold the mast which maintains it stiffened along it's outer edge for the whole of it's length. The two remaining wing foils are stiffened with spars for roughly three-quarters of their length being unsupported towards the nose of the kite. The cross-stay is disposed across the back of the kite and is pivotally secured to the wing-spars ahead of half of their length. A single fulcrum on the mast holds the line. There is no central stiffening member so the kite is flexible. The aerodynamic curve to the top of the keel also reforms the shape of the wings, giving lift from both the front and the side of the kite, causing the wings to oscillate in the air, or flap to the manipulated tension on the line.

1 Claim, 4 Drawing Figures

MANEUVERABLE GLIDER KITE

BACKGROUND TO THE INVENTION

This invention is the result of many years spent studying the effects of kite-construction factors, and eliminating those considered to be detrimental to balanced flight. These are.

1. Central stiffening member; As the kite rides the wind it tries to follow the shape of the laminar. A central member causes strain and drag.

2. Non-rigid leading edge to ventral fin: As wind hits the kite from the side, these fins distort and throw the kite off course by presenting a curved edge to the oncoming laminar.

3. Central support for cross-stay: This was found to take a great strain where it crosses the mast, and was discarded in favour of a cross-stay on the back of the kite.

4. Vee-shaped bridles: These tend to hold the kite too much on the wind. A single fulcrum flies the kite higher above the flier and adjusts to gusts.

A study of hang-gliders led to the attempt to fly a model as a kite. This performed well in moderate air, but badly in gusts. By sewing together the wings in a straight line (see Bochau U.S. Pat. No. 1,105,058) the kite, being three-dimensional, was found to ride in almost any air, but sailed too quickly through the wind on ocean beaches. By using the shape of the veins on a butterfly's wing painted on to the kite as the top of the keel, it was found that sufficient drag was obtained to allow the kite to fly in high wind. It was also found that side gusts could be used for lift, and that the kite would flap it's wings if left tethered, and that the wings could be made to flap by pulling with a pumping action on the line. In a free fall, this kite ravels further on a reach than either into or with the wind. There is relatively little strain on any member as the fabric adjusts to the wind, straightening the curve when necessary.

The object of this invention is to make a safe, stable kite that will fly in heavy or light winds, as a hand kite tethered to a line.

Previous delta wing kites developed from the Rogallo kite are unstable in high winds and prone to stress. Such kites usually have a bridle or ventral fin of fabric below the keel, for the line, and too much tension on the line causes the kite to become distorted and dive. Box-kites, being fixed in three dimensions, are stable in high winds.

This trefoil kite combines the great sail area of the delta wing kite with the stability of the box-kite, by joining the two sails together, almost parallell to and a short distance from, the mast, forming three foils — two horizontal wings and one vertical keel.

This device was found to set the two sails, one against the other, in a good flying shape. The mast, being the lowest part of the kite, cuts the wind and flows it squarely up to the sails.

When the vertical keel area of sail has an aerodynamic curve where the keel foil joins the wing foils, the contour adapts to the wind velocity and compensates for bending of the mast, resulting in a very stable kite. The joining by stitching together the two sails some distance from the mast is the preferred part of the design, because it combines the flat kite and the box-kite in a soft flexible shape, using only a mast, two spars and a cross-stay as support.

Figure 1:
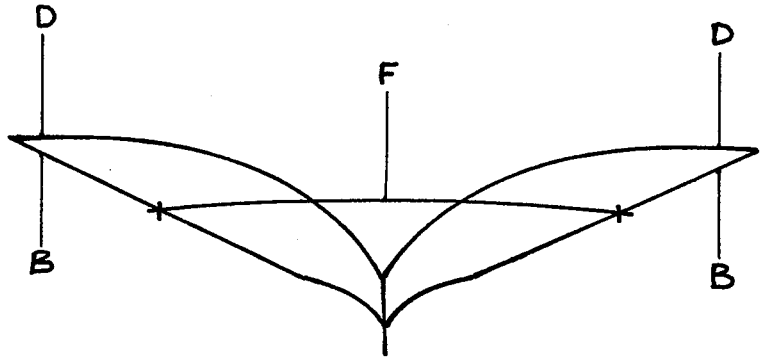
FIG. 1 shows the front elevation of the kite in flight. The cross-bar F is extending the wings D which are held rigid for most of their length by wing-spars B.
Figure 2:
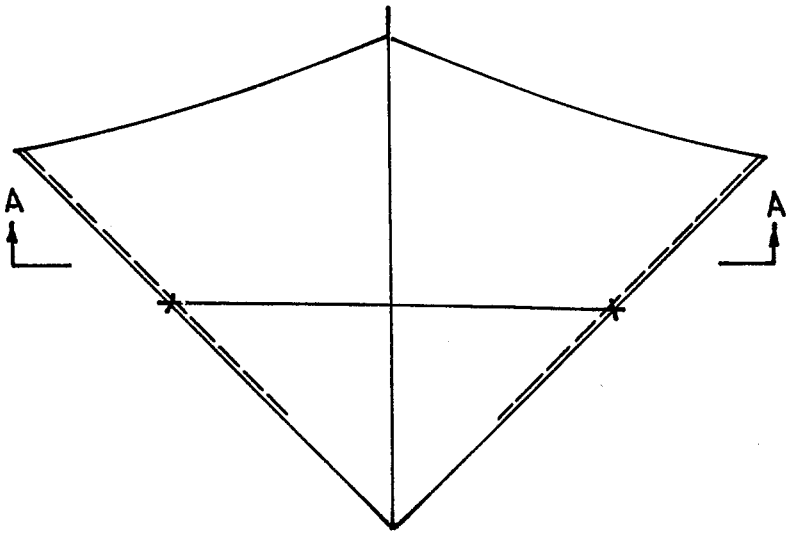
FIG. 2 shows a plan view of the finished kite.
Figure 3:
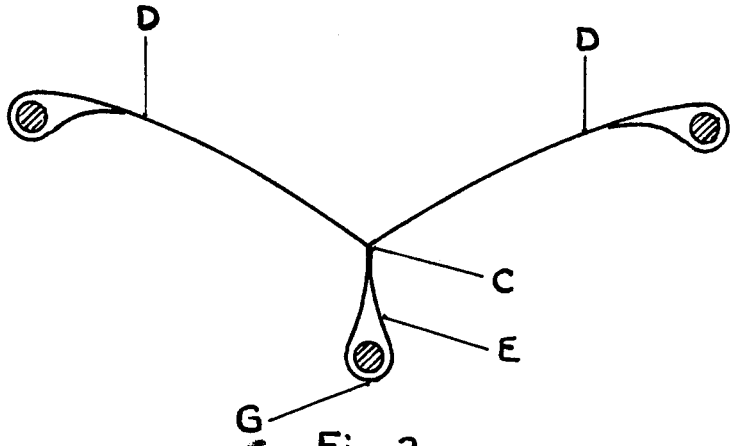
FIG. 3 shows a cross-section of the kite through the wing-spars and the mast on A—A on FIG. 2. The keel is formed by joining the two sails together at G, and then again at C, in an aerodynamic curve to both the top of the keel E and the junction of the wings, D.
Figure 4:
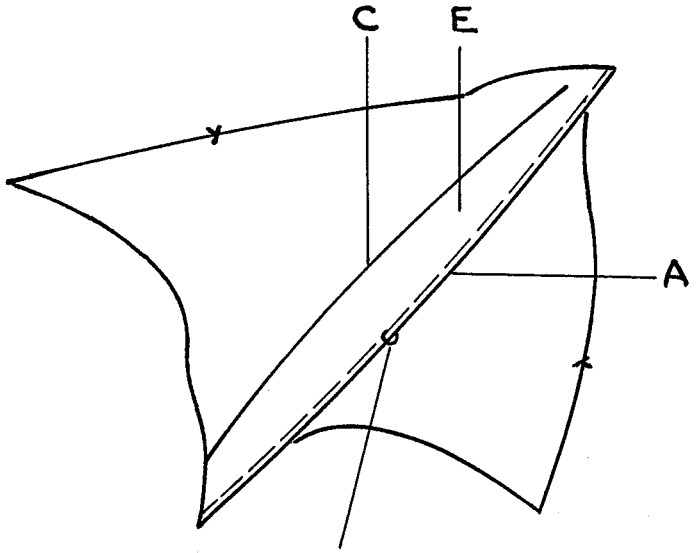
FIG. 4 shows a three-quarter view of the finished kite and the line C formed by the two wings being joined together to form an aerodynamic keel E, inside the lower edge of which is fitted, for the whole of it's length, the mast A.

THE DESCRIPTION OF THE KITE IS AS FOLLOWS;

The kite has three foils.

The kite is made of two substantially triangular panels of pliable fabric joined along the base edges to form two symmetrical sails, and joined again, with a pliable row of stitching C, roughly parallell to the base edge and enclosing approximately one-fourth of the sail area, to form a double keel E. The remaining vertexes of the two triangles form the wings D. (see Drawing)

The frame consists of a mast A, two spars B, and a cross-stay F. One of the spars B, is attached to the leading edge of each wing foil, and maintains it stiffened. The cross-stay F, is disposed across the back of the kite at right angles to the mast A, and attached pivotally to the spars at the leading edges of the wings and approximately centrally thereof, maintaining the wings in a spread position. The mast A, is disposed longitudinally and is held in the lower edge of the keel foil and maintains the edge in position. The keel foil hangs vertically from the wings and an attachment for a line is sited roughly centrally along the mast.

The central pliable join between the wings and the keel has an aerodynamic curve providing both lift and drag to the kite and has no stiffening member. The curve has a smooth contour in the longitudinal vertical plane, and the shape of this curve varies slightly with the size and weight of the kite.

This construction has the effect of a kite with three foils comprising a pair of substantially triangular wings made of pliable material and a keel of pliable material depending therefrom, the bottom edge of the keel and the leading edges of the wings being stiffened by a mast and two spars respectively, the wings being held in a spread position by a cross-stay non-rigidly connected to each spar member, the longitudinal upper edge of the keel adjacent to the wings and the wings thereat having a smooth aerodynamic contour in the longitudinal vertical plane.

I claim:

1. A kite, comprising a pair of substantially triangular panels made of pliable material joined along the base edges to form two sails, and joined again along a central joining line spaced from and curved with respect to said base line, and enclosing a portion of the sail area to form a keel, the longitudinal upper edge of the keel formed by said central joining line and the wings thereat having a smooth aerodynamic curve in the longitudinal vertical plane, the bottom edge of the keel and the leading edges of the wings being stiffened by a mast and two spars respectively, the wings being held in a spread position by a cross-stay non-rigidly connected to each spar member.

* * * * *